US005176363A

United States Patent [19]

Bowlin

[11] Patent Number: 5,176,363

[45] Date of Patent: Jan. 5, 1993

[54] LIFT BAR

[76] Inventor: Bob L. Bowlin, 11 Dino Dr., Keasbey, N.J. 08832

[21] Appl. No.: 871,907

[22] Filed: Apr. 21, 1992

[51] Int. Cl.[5] ..... B66F 3/00

[52] U.S. Cl. ..... 254/131

[58] Field of Search ..... 254/131, 25, 131.5; 16/115; 81/45, 46; 30/312

[56] References Cited

U.S. PATENT DOCUMENTS

| | | | |
|---|---|---|---|
| 195,412 | 9/1877 | Spurr et al. . | |
| 857,077 | 6/1907 | Labreck . | |
| 1,309,734 | 7/1919 | Hemfling, Sr. . | |
| 1,343,862 | 6/1920 | Williams . | |
| 1,375,751 | 4/1921 | Grannis | 254/131 |
| 1,517,591 | 12/1924 | Shook . | |
| 1,559,976 | 11/1925 | Ness . | |
| 2,680,003 | 6/1954 | Feinstein . | |
| 3,049,337 | 8/1962 | Griggs | 254/131 |
| 3,113,758 | 12/1963 | Knowles | 254/131.5 |
| 3,987,827 | 10/1976 | Mills | 254/25 |
| 4,182,390 | 1/1980 | Renner | 254/25 |
| 4,198,090 | 4/1980 | Gutman | 254/131.5 |
| 4,427,182 | 1/1984 | Marik | 254/131 |

*Primary Examiner*—Robert C. Watson
*Attorney, Agent, or Firm*—Ralph W. Selitto, Jr.

[57] ABSTRACT

A lift bar for disassembling a structure while preserving the components for reuse includes a handle and a fork-like member connected thereto. Upon the manual depression of the handle, the fork-like member pivots upward to pry a board or a sheet of building material away from an underlying support member. The lift bar also includes a deflecting assembly removably mounted on the handle so as to deflect a loosened sheet of material away from an operator.

32 Claims, 3 Drawing Sheets

LIFT BAR

FIELD OF THE INVENTION

The present invention relates, in general, to a tool for use when disassembling structures, and, more particularly, to an improved lift bar which facilitates removal of sheets of plywood or boards attached to support members such as beams, studs, roof stringers, rafters, pallets, joists, and the like.

BACKGROUND OF THE INVENTION

Tools for disassembling roofs and similar structures while preserving components for reuse have been known since at least the end of the 19th century. The tools usually include a fork-like base attached to a handle. The base has a pair of spaced-apart prongs adapted to straddle a beam, joist, pallet, rafter, roof stringer, stud, or similar support member in such a manner that the prongs are positioned below flooring or roofing boards which are nailed or otherwise fastened to their underlying support member. The handle is adapted to pivot the base when the handle is manually depressed, thereby prying the flooring or roofing boards from the support member.

One such tool is disclosed in U.S. Pat. No. 1,559,976 which relates to a wrecking bar having a handle portion and a board-engaging head which includes spaced arms for engaging a board at opposite sides of a supporting beam in order to pry the board away from the supporting beam. While the wrecking bar is adapted to remove boards, it is not adapted to remove large sheets of plywood and other sheet-like building materials which are commonly used in modern day construction.

U.S. Pat. No. 2,680,003 discloses a similar tool in the form of a ripping bar having arms which extend outwardly from an associated handle. The arms are placed under a wall board in such a manner that the depression of the handle will cause the arms to pry the wall board free of underlying studding without splitting the wall board. While the ripping bar is adapted to remove boards, it is not adapted to remove large sheets of plywood and other sheet-like building materials which are commonly used in modern day construction.

Other similar tools are disclosed in the following U.S. Pat. Nos.: 195,412; 857,077; 1,309,734; 1,343,862; and 1,517,591. Like the tools disclosed in U.S. Pat. Nos. 1,559,976 and 2,680,003, the tools disclosed in these additional patents are not equipped to remove large sheets of plywood and other sheet-like building materials which are commonly used in modern day construction.

SUMMARY OF THE INVENTION

The present invention obviates the shortcomings of the prior art devices described above by providing a unique attachment for a lift bar which normally includes a handle and a fork-like member attached to one end of the handle such that the fork-like member and the handle form an obtuse angle therebetween. In accordance with the present invention, the attachment includes a deflector mounted on the handle so as to deflect a sheet of material away from the handle and hence an operator who is using the lift bar to remove sheets of material from underlying support members, such as beams, studs, roof stringers, rafters, pallets, joists, and the like.

The position of the deflector can be adjusted along the length of the handle. The distance between the deflector and the handle can also be adjusted. As a result of these adjustments, the attachment can be configured to deflect sheets having various different sizes, shapes and bending characteristics, thereby facilitating the removal of such sheets while protecting an operator during the removal operation.

The adjustment of the position of the attachment along the length of the handle can be accomplished remotely (i.e., by an operator stationed at the opposite end the handle). Such remote adjustment can be provided by an actuator which extends from the deflector toward the opposite end of the handle. The actuator may also cooperate in locking the deflector in place along the length of the handle.

When the lift bar is used to remove planks or boards, as compared with sheets of plywood and other building materials, the attachment can be removed from the handle of the lift bar. By making the handle of the lift bar from a plurality of detachable sections, the handle can be shortened for use in confined areas, such as in a corner or adjacent to a wall.

BRIEF DESCRIPTION OF THE DRAWINGS

For a more complete understanding of the present invention, reference may be had to the following detailed description considered in conjunction with the accompanying drawings, in which.

DETAILED DESCRIPTION OF THE EXEMPLARY EMBODIMENT

Figure 1:
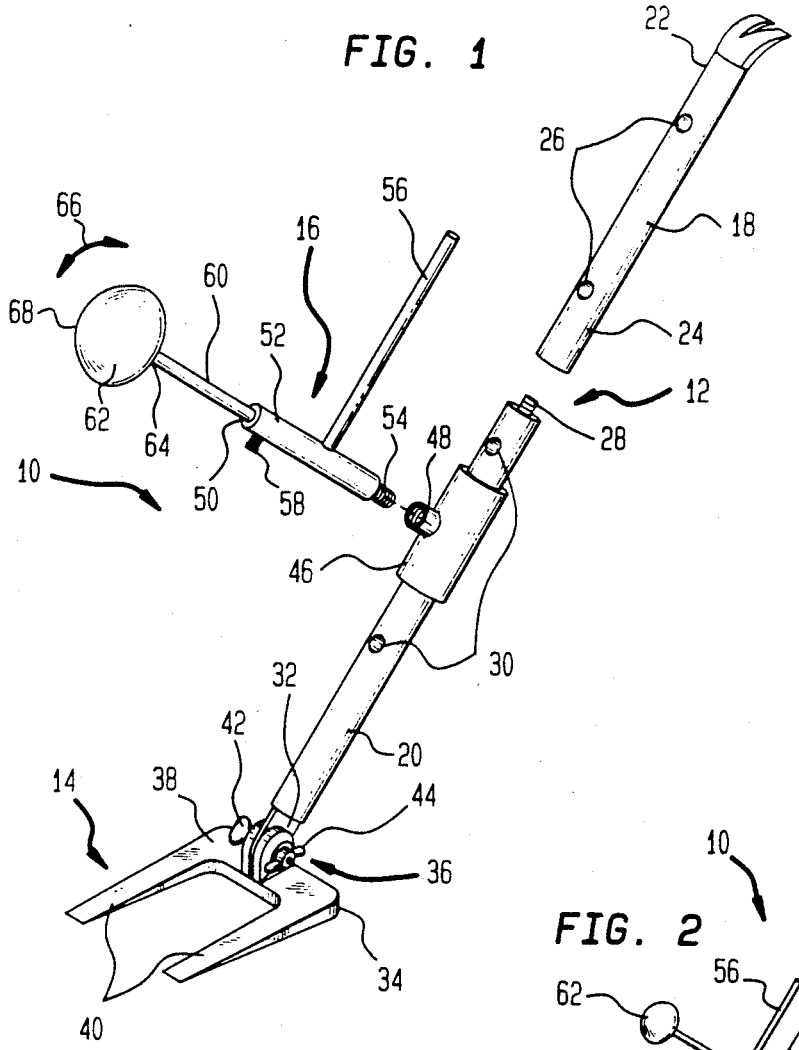
FIG. 1 is a partially exploded perspective view of a lift bar constructed in accordance with one exemplary embodiment of the present invention.

Referring to FIG. 1, a lift bar 10 consists of a handle assembly 12 pivotally connected to a fork assembly 14 and a deflecting assembly 16 mounted on the handle assembly 12. Each of these assemblies will be individually described in greater detail hereinafter.

The handle assembly 12 is a two-piece unit consisting of an upper handle section 18 and a lower handle section 20. The upper handle section 18 and the lower handle section 20 are removably attached to each other in a manner which will be described hereinafter.

The upper handle section 18 has an upper end 22 of a claw-like configuration adapted to remove nails or similar fasteners. A lower end 24 of the upper handle member 18 is internally threaded for a purpose to be described hereinafter. The upper handle section 18 also includes a plurality of holes 26 spaced along its length for a purpose to be described hereinafter.

An upper end 28 of the lower handle section 20 is externally threaded to engage the internally threaded lower end 24 of the upper handle 18, thereby removably attaching the upper handle section 18 to the lower handle section 20. The lower handle section 20 also includes a plurality of holes 30 spaced along its length and aligned with the holes 26 in the upper handle section 18 for a purpose to be described hereinafter. A lower end 32 of the lower handle section 20 is provided with an opening (not shown) for use in connecting the handle assembly 12 to the fork assembly 14.

The fork assembly 14 has a fork-like member 34, which is connected to the handle assembly 12 at the lower end 32 of the lower handle section 20 by a pivot mechanism 36. The fork-like member 34 includes a base 38 having a substantially U-shaped configuration. The base 38 is formed by a pair of spaced-apart arms 40, which may be tapered and slightly sharpened, if desired. The pivot mechanism 36 includes a bolt 42 which is threaded so that it can receive a wing nut 44.

The deflecting assembly 16 is removably attached to the handle assembly 12 such that its position along the length of the handle assembly 12 can be adjusted. The deflecting assembly 16 includes a cylindrical collar 46 that fits around the handle assembly 12. The collar 46 is provided with a lug 48 having an internally threaded bore (not shown) passing therethrough.

A telescopic mounting bar 50 extends outwardly from the collar 46 substantially perpendicular to the handle assembly 12. The mounting bar 50 includes an outer section 52 with an externally threaded end 54 adapted to threadedly engage the internally threaded bore (not shown) passing through the lug 48 on the collar 46. The end 54 of the outer section 52 is sized and shaped so as to fit in one of the holes 26 on the upper handle section 18 or in one of the holes 30 on the lower handle section 20. An actuator rod 56 projects outwardly from the outer section 52 substantially perpendicular to the mounting bar 50 and substantially parallel to the handle assembly 12. A set screw 58 is received in a threaded bore (not shown) extending through a side of the outer section 52.

The mounting bar 50 also includes an inner section 60 which is slidably received in the outer section 52 and which can be locked in position relative to the outer section 52 by the set screw 58. A deflector plate 62 is pivotally mounted on an outer end 64 of the inner section 58 of the mounting bar 50, whereby the deflector plate 62 can pivot in the direction of arrow 66 to thereby adjust its angle of inclination. The deflector plate 62 may have any suitable shape. Preferably, the deflector plate 62 is provided with a curved outer surface 68 whose function will be described hereinafter.

Figure 2:
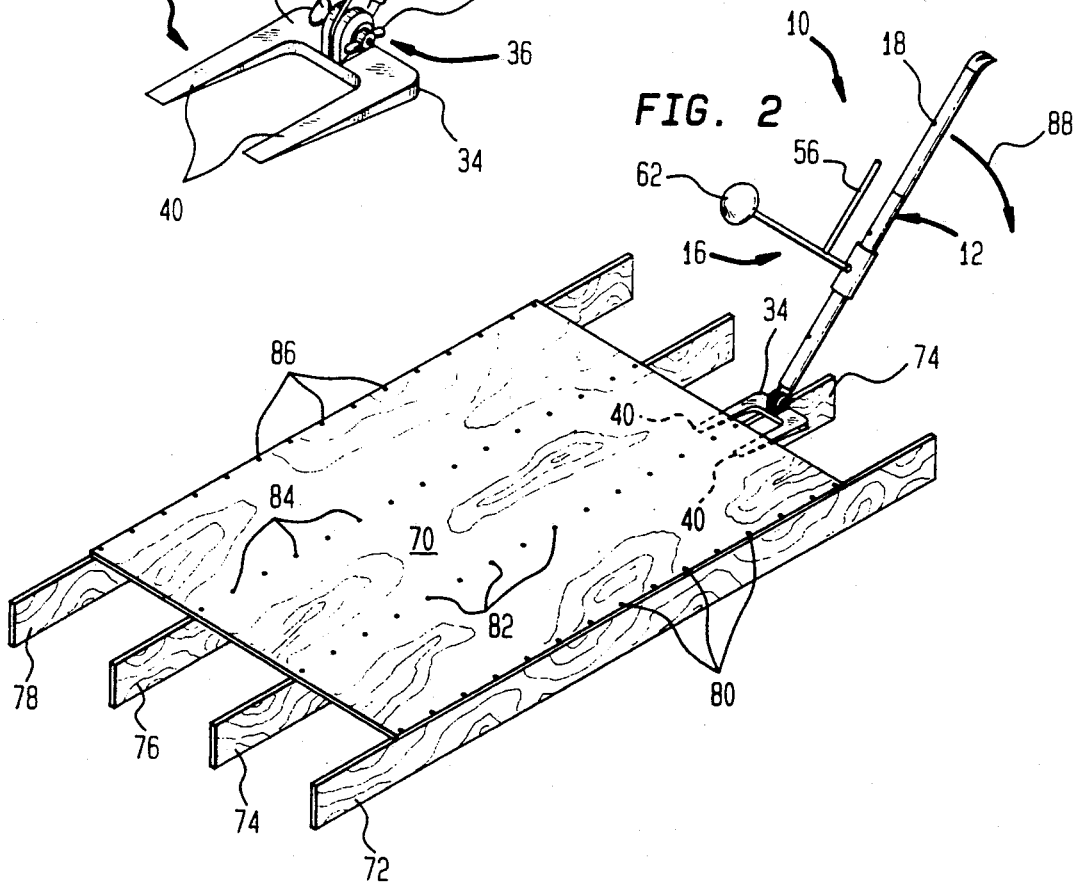
FIG. 2 is a perspective view showing the lift bar of FIG. 1 as it is being positioned in preparation for the removal of a sheet of plywood from a plurality of underlying support beams.
Figure 3:
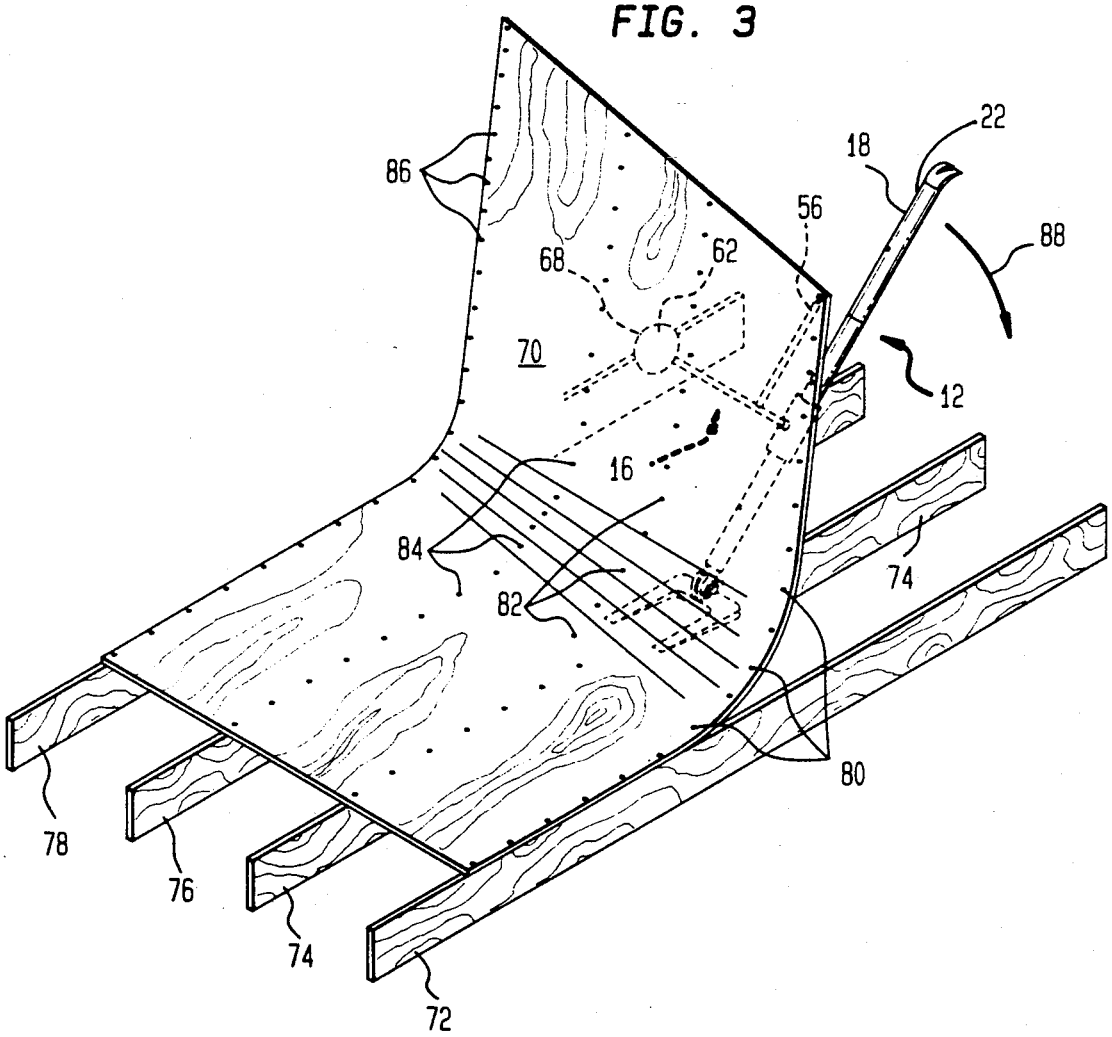
FIG. 3 is a perspective view showing the lift bar of FIG. 1 as it is being used to remove the sheet of plywood shown in FIG. 2 from its underlying support beams.

With reference to FIGS. 2 and 3, the lift bar 10 is especially useful for prying a plywood sheet 70 from support beams 72, 74, 76, and 78, which are secured to the plywood sheet 70 by rows of nails 80, 82, 84, and 86, respectively. Initially, an operator gripping the lift bar 10 by its upper handle section 18 would slide the fork-like member 34 under the plywood sheet 70 such that the arms 40 straddle the support beam 74. Upon the manual depression of the handle assembly 12 in the direction of arrow 88, the fork-like member 34 pivots upward to pry the plywood sheet 70 away from the beam 74. In this manner, at least some of the nails 82 may be loosened. A similar procedure may be repeated, if necessary, to loosen additional nails 80, 84, and 86 along beams 72, 76, and 78, respectively. It may also be necessary to repeat the procedure to loosen additional nails 82 further along the beam 74, and so on.

When the plywood sheet 70 has been loosened to the extent illustrated in FIG. 3, the freed end of the plywood sheet 70 has a tendency to spring back toward the handle assembly 12 and hence at the operator. The deflecting assembly 16, shown in an extended position in FIG. 3, functions to deflect the freed end of the plywood sheet 70 away from the handle assembly 12 and hence away from the operator, thereby providing an efficient and safe way of removing the plywood sheet 70 from the support beams 72, 74, 76 and 78. The curvature of the outer surface 68 of the deflector plate 62 is specifically designed so as to facilitate the deflection of the plywood sheet 70 away from the handle assembly 12 and hence the operator.

Once the plywood sheet 70 is removed from the support beams 72, 74, 76, and 78, it may be cleared of the nails 80, 82, 84, and 86 and then reused. Such clearing may be effected by disconnecting the upper handle section 18 and using its claw-like upper end 22 to remove the nails 80, 82, 84, and 86 from the plywood sheet 70.

The lift bar 10 has several adjustable features that enable an operator to configure the handle assembly 12 and the deflecting assembly 16 to deflect sheets of various different shapes, sizes, and bending characteristics. For example, an operator is able to determine how far to extend the telescopic mounting bar 50 so that the deflecting assembly 16 could engage the material being removed. During the initial stages of a removal operation, the operator may work with the deflecting assembly 16 in a fully retracted position, as shown in FIG. 2. As the removal operation progresses, it may be beneficial to extend the length of the mounting bar 50, as shown in FIG. 3.

In addition, the operator has the ability to selectively position the deflecting assembly 16 along the length of the handle assembly 12 by securing the collar 46 at any desired location along the handle assembly 12. For instance, the collar 46 may be secured at a location defined by one of the holes 26, 30 on the handle assembly 12 or at any one of the infinite number of locations between the holes 26, 30. The adjustment of the position of the deflecting assembly 16 along the length of the handle assembly 12 can be accomplished remotely (i.e., by an operator stationed at the end 22 of the upper handle section 18). Such remote adjustment can be achieved by moving the actuator rod 56 in one lateral direction and thereby causing the mounting bar 50 to rotate in an arcuate direction selected to retract the end 54 of the mounting bar 50 out of the holes 26, 30 or to disengage the end 54 of the mounting bar 50 from the handle assembly 12 itself. While still gripping the actuator rod 56, the operator would then slide the unlocked deflecting assembly 16 along the handle assembly 12 in order to select a new position. Once a new position has been selected, the foregoing steps would be reversed in order to lock the deflector assembly 16 in its new position. Alternatively, the unlocked deflecting assembly 16 could be removed from the lift bar 10 by sliding it off of the handle assembly 12.

Figure 4:
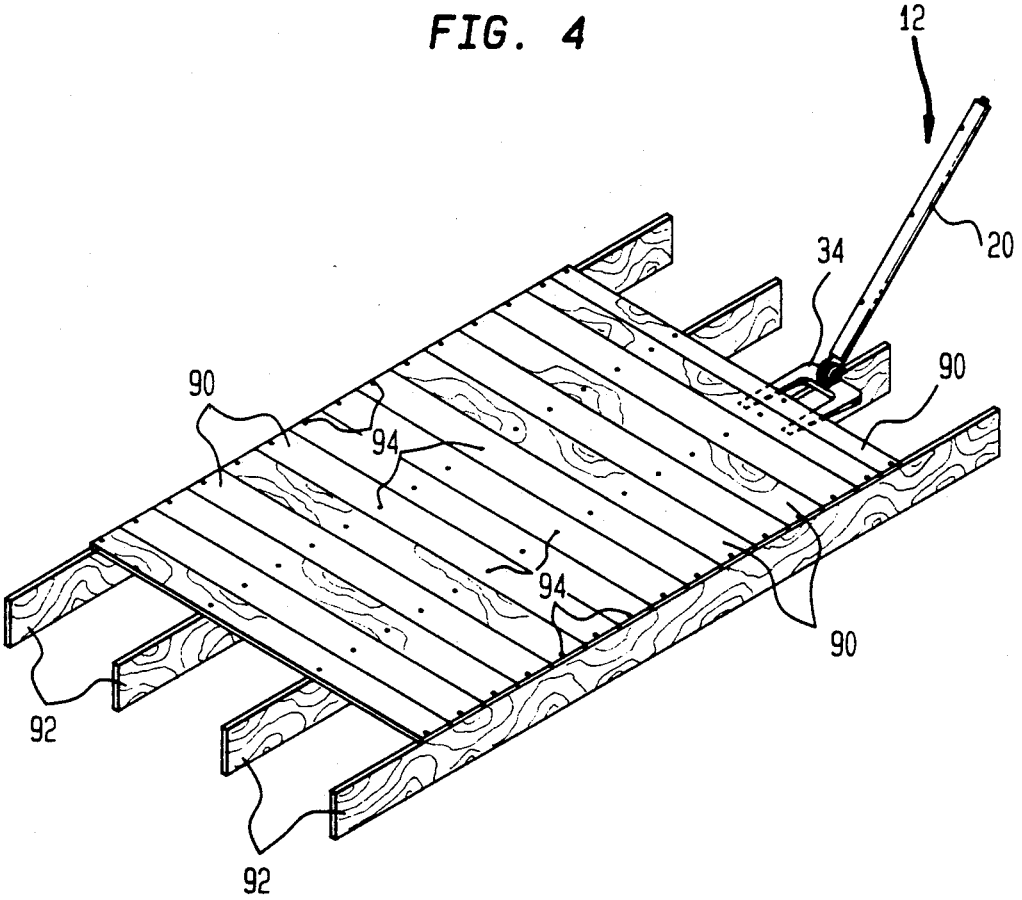
FIG. 4 is a perspective view of the lift bar of FIG. 1 after it has been modified for use in removing a group of boards or planks from a plurality of underlying support beams.

FIG. 4 shows the lift bar 10 of FIG. 1 after it has been modified for use in removing a group of boards 90 from underlying support beams 92 to which they have been secured by nails 94. When the lift bar 10 is used to remove planks or boards 90, as compared with sheets of plywood and similar building materials, the deflecting assembly 16 can be removed from the handle assembly 12 of the lift bar 10 in the manner described above. Additionally, because the handle assembly 12 of the lift bar 10 is made from a plurality of detachable sections, the handle assembly 12 can be shortened for use in confined areas, such as in a corner or adjacent to a wall. Thus, FIG. 4 shows the lift bar 10 with the upper handle section 18 detached from the lower handle section 20. The ability to remove the deflecting assembly 16 and the upper handle section 18 facilitates use of the lift bar 10 on a smaller project or by a smaller person. Upon the manual depression of the lower handle section 20, the fork-like member 34 pivots upward to pry at least one of the boards 90 away from one or several of the underlying support beams 92. This step is repeated until each of the boards 90 is completely loosened from all the beams 92.

It will be understood that the embodiment described herein is merely exemplary and that a person skilled in the art may make many variations and modifications without departing from the spirit and scope of the invention. For example, while the lift bar 10 is described in use with respect to horizontal support members or structures such as flooring or roofing, the invention can also be used on vertical support members such as walls and the like. Thus, all such variations and modifications are intended to be included within the scope of the invention as defined in the appended claims.

I claim:

1. A lift bar for disassembling structures by prying boards or sheets of material off of support members, comprising a handle having a pair of ends; a fork-like member attached to one end of said handle such that said fork-like member and said handle form an obtuse angle therebetween; and deflecting means, removably mounted on said handle between said ends thereof, for deflecting a sheet of material away from said handle and hence an operator who is stationed at an opposite end of said handle and who is using said lift bar to remove sheets of material.

2. A lift bar according to claim 1, wherein said fork-like member includes a pair of spaced-apart arms arranged in a substantially U-shaped configuration, said arms being spaced apart a distance sufficient to permit said fork-like member to straddle support members.

3. A lift bar according to claim 1, wherein said fork-like member includes adjusting means for adjusting the angle between said fork-like member and said handle.

4. A lift bar according to claim 1, wherein said handle is made from a plurality of detachable pieces, whereby the length of said handle may be varied.

5. A lift bar according to claim 1, wherein said deflecting means includes a deflector plate extending outwardly from a side of said handle which faces a sheet of material being removed, whereby said deflector plate engages a sheet of material during its removal.

6. A lift bar according to claim 5, wherein said deflecting means includes adjusting means for adjusting the position of said deflecting means along the length of said handle.

7. A lift bar according to claim 6, wherein said adjusting means includes locking means for locking said adjusting means in position along the length of said handle.

8. A lift bar according to claim 7, wherein said deflecting means can be locked in any one of a number of preselected positions along the length of said handle.

9. A lift bar according to claim 7, wherein said deflecting means can be locked in any one of a number of infinite positions along the length of said handle.

10. A lift bar according to claim 7, wherein said locking means includes actuating means for actuating and deactuating said locking means from a remote location.

11. A lift bar according to claim 10, wherein said locking means includes an actuator member extending from said deflecting means toward said opposite end of said handle, whereby said actuator member is accessible to an operator who is stationed at said opposite end of said handle.

12. A lift bar according to claim 5, wherein said deflector plate has an outer surface which is curved so as to guide a sheet of material away from said handle.

13. An attachment for a lift bar adapted to disassemble structures by prying boards or sheets of material off of support members and including a handle having a pair of ends and a fork-like member attached to one end of said handle such that said fork-like member and said handle form an obtuse angle therebetween, said attachment comprising deflecting means for deflecting a sheet of material away from the handle of the lift bar and hence an operator who is using the lift bar to remove sheets of material; and mounting means for removably mounting said deflecting means on the handle of the lift bar between the ends thereof.

14. An attachment according to claim 13, wherein said deflecting means includes a deflector plate extending outwardly from a side of said handle which faces a sheet of material being removed, whereby said deflector plate engages a sheet of material during its removal.

15. An attachment according to claim 14, wherein said deflecting means includes adjusting means for adjusting the position of said deflecting means along the length of said handle.

16. An attachment according to claim 15, wherein said adjusting means includes locking means for locking said adjusting means in position along the length of said handle.

17. An attachment according to claim 16, wherein said deflecting means can be locked in any one of a number of preselected positions along the length of said handle.

18. An attachment according to claim 16, wherein said deflecting means can be locked in any one of a number of infinite positions along the length of said handle.

19. An attachment according to claim 16, wherein said locking means includes actuating means for actuating and deactuating said locking means from a remote location.

20. An attachment according to claim 19, wherein said locking means includes an actuator member extending from said deflecting means toward said opposite end of said handle, whereby said actuator member is accessible to an operator who is stationed at said opposite end of said handle.

21. An attachment according to claim 14, wherein said deflector plate has an outer surface which is curved so as to guide a sheet of material away from said handle.

22. A lift bar for disassembling structures by prying boards or sheets of material off of support members, comprising a handle having a pair of ends; a fork-like member attached to one end of said handle such that said fork-like member and said handle form an obtuse angle therebetween; and deflecting means, mounted on said handle between said ends thereof, for deflecting a sheet of material away from said handle and hence an operator who is stationed at an opposite end of said handle and who is using said lift bar to remove sheets of material, said deflecting means including a deflector plate extending outwardly from a side of said handle which faces a sheet of material being removed, whereby said deflector plate engages a sheet of material during its removal, and adjusting means for adjusting the position of said deflecting means along the length of said handle.

23. A lift bar according to claim 22, wherein said fork-like member includes a pair of spaced-apart arms arranged in a substantially U-shaped configuration, said arms being spaced apart a distance sufficient to permit said fork-like member to straddle support members.

24. A lift bar according to claim 22, wherein said fork-like member includes adjusting means for adjusting the angle between said fork-like member and said handle.

25. A lift bar according to claim 22, wherein said handle is made from a plurality of detachable pieces, whereby the length of said handle may be varied.

26. A lift bar according to claim 22, wherein said adjusting means includes locking means for locking said adjusting means in position along the length of said handle.

27. A lift bar according to claim 26, wherein said deflecting means can be locked in any one of a number of preselected positions along the length of said handle.

28. A lift bar according to claim 26, wherein said deflecting means can be locked in any one of a number of infinite positions along the length of said handle.

29. A lift bar according to claim 26, wherein said locking means includes actuating means for actuating and deactuating said locking means from a remote location.

30. A lift bar according to claim 29, wherein said locking means includes an actuator member extending from said deflecting means toward said opposite end of said handle, whereby said actuator member is accessible to an operator who is stationed at said opposite end of said handle.

31. A lift bar according to claim 22, wherein said deflector plate has an outer surface which is curved so as to guide a sheet of material away from said handle.

32. A lift bar according to claim 22, wherein said deflecting means is removably mounted on said handle.

* * * * *